US011358179B2

(12) United States Patent
Havenith et al.

(10) Patent No.: US 11,358,179 B2
(45) Date of Patent: Jun. 14, 2022

(54) APPARATUS AND METHOD FOR SORTING

(71) Applicant: AMAG casting GmbH, Braunau am Inn-Ranshofen (AT)

(72) Inventors: Andreas Wilhelm Havenith, Stolberg (DE); John Paul Hermann Kettler, Inden/Altdorf (DE)

(73) Assignee: AMAG casting GmbH, Braunau am Inn-Ranshofen (AT)

( * ) Notice: Subject to any disclaimer, the term of this patent is extended or adjusted under 35 U.S.C. 154(b) by 60 days.

(21) Appl. No.: 16/347,542

(22) PCT Filed: Nov. 3, 2017

(86) PCT No.: PCT/EP2017/078245
§ 371 (c)(1),
(2) Date: May 3, 2019

(87) PCT Pub. No.: WO2018/083273
PCT Pub. Date: May 11, 2018

(65) Prior Publication Data

US 2021/0001376 A1 Jan. 7, 2021

(30) Foreign Application Priority Data

Nov. 3, 2016 (EP) ..... 16197186

(51) Int. Cl.
*B07C 5/34* (2006.01)
*B07C 5/346* (2006.01)

(52) U.S. Cl.
CPC ..... *B07C 5/346* (2013.01); *B07C 2501/0036* (2013.01)

(58) Field of Classification Search
CPC ..... B07C 5/346; B07C 251/0036
See application file for complete search history.

(56) References Cited

U.S. PATENT DOCUMENTS

| | | | | |
|---|---|---|---|---|
| 3,633,732 | A | 1/1972 | Russell et al. | |
| 4,361,534 | A | 11/1982 | Borsaru et al. | |
| 5,813,543 | A | 9/1998 | Gesing et al. | |
| 6,266,390 | B1 | 7/2001 | Sommer, Jr. et al. | |
| 9,486,839 | B2 * | 11/2016 | Torek | B07C 5/3416 |

(Continued)

FOREIGN PATENT DOCUMENTS

| | | | |
|---|---|---|---|
| CA | 1125221 | A | 6/1982 |
| EP | 0096092 | A1 | 12/1983 |

(Continued)

*Primary Examiner* — Patrick H Mackey

(57) ABSTRACT

An apparatus and a method for sorting, particularly chopped, aluminum scrap by alloy groups are disclosed, in which the aluminum scrap is separated into fractions, fractions of the aluminum scrap are irradiated by at least one neutron source, the gamma radiation that the individual fraction emits due to this neutron irradiation is detected by at least one detector, and based on this, an energy spectrum associated with the respective fraction is generated, based on which energy spectrum a relative ratio of the weight proportions of at least two alloy elements of this fraction is determined, and based on this relative ratio, this fraction is allocated to its corresponding alloy group, and then the fractions are sorted by the alloy groups to which they have been allocated.

14 Claims, 2 Drawing Sheets

(56) References Cited

U.S. PATENT DOCUMENTS

| | | | | |
|---|---|---|---|---|
| 10,486,209 | B2 * | 11/2019 | Wimmer | B07C 5/34 |
| 10,710,119 | B2 * | 7/2020 | Kumar | B07C 5/3422 |
| 2006/0115037 | A1 * | 6/2006 | Pedersen | B07C 5/346 376/159 |
| 2010/0017020 | A1 | 1/2010 | Hubbard-Nelson et al. | |
| 2016/0144409 | A1 * | 5/2016 | Kamada | B07C 5/346 209/576 |
| 2019/0091729 | A1 * | 3/2019 | Gillner | G01N 21/718 |
| 2020/0282430 | A1 * | 9/2020 | Shen | B07C 5/34 |

FOREIGN PATENT DOCUMENTS

| | | | |
|---|---|---|---|
| EP | 3059581 | A1 | 8/2016 |
| FR | 2531316 | A1 | 2/1984 |
| FR | 2869107 | A1 | 10/2005 |
| WO | 2008021228 | A2 | 2/2008 |
| WO | 2017108908 | A1 | 6/2017 |

* cited by examiner

APPARATUS AND METHOD FOR SORTING

FIELD OF THE INVENTION

The invention relates to a method for sorting, particularly chopped, aluminum scrap by alloy groups.

DESCRIPTION OF THE PRIOR ART

In the prior art (US 2010/0017020 A1), a method for preparing metallic scrap (for example aluminum) has been disclosed in which the scrap is separated into fractions and these fractions are irradiated with X-radiation by an X-ray source. In this case, the gamma radiation that the fraction emits is detected by a detector and an energy spectrum associated with the fraction is generated, based on which a conclusion is drawn about the material composition of the fraction. In accordance with the material composition that is determined in this way, the fractions are sorted into material groups. Such a method, however, is not suitable for sorting fractions into individual alloy groups (for example of aluminum) since it is not possible to achieve sufficient precision in the allocation of the energy spectra. In addition, such methods—not least because of the comparatively long measurement duration—have a relatively low mass throughput.

SUMMARY OF THE INVENTION

The object of the invention, therefore, is to create an apparatus and method for sorting aluminum scrap, which features a high mass throughput and high reliability when sorting aluminum scrap into alloy groups.

If in the method according to the invention for sorting, particularly chopped, aluminum scrap by alloy groups, in a first method step, the aluminum scrap is separated into fractions, then it is possible to achieve a reliable separation of the aluminum scrap and at the same time to ensure that the determination of the alloy group is performed exclusively on a single fraction. Reciprocal influences due to interference between the energy spectra of the kind that can be expected with the simultaneous measurement of multiple fractions can thus be reliably prevented.

If the fractions of the aluminum scrap are then irradiated by at least one neutron source, the gamma radiation that the individual fraction emits due to this neutron irradiation is detected by at least one detector, and based on this, an energy spectrum associated with the respective fraction is generated, then the chemical composition of the individual fractions can be determined in a simple way and with a high degree of precision.

If in addition, based on such an energy spectrum, a relative ratio of the weight proportions of at least two alloy elements of this fraction is determined, then based on this relative ratio, this fraction can be allocated to its corresponding alloy group—without particular difficulty, but nevertheless reliably. These fractions can then be sorted by their allocated alloy groups. The latter is possible, among other things, because this does not require any complicated method calibrations of the kind that are known from the prior art.

In general, the term alloy groups is understood to mean a classification of aluminum alloys into groups of aluminum forging alloys according to EN 573-3/4 or aluminum casting alloys according to DIN EN 1706. For example, the method according to the invention is suitable for sorting the aluminum scrap fractions into 3xxx-, 4xxx-, 5xxx-, etc. alloy groups. It should also be generally noted that a fraction is understood to mean multiple aluminum scrap particles or also individual aluminum scrap particles. A fraction can, however, also be understood to be a predefined partial quantity of aluminum scrap powder or granulate. In general, it is also noted that the measuring method on which the method is based (detection and generation of the energy spectrum) can be embodied in the form of a "neutron activation analysis" (NAA) or in special cases, a "prompt gamma neutron activation analysis" (PGNAA).

If the aluminum scrap is provided in chambers that are demarcated from one another and is thus separated into fractions, then it is possible to group or separate scrap pieces into fractions in a way that is simple from a process standpoint. For example, the chambers can each have a predefined volume and/or can be used to accommodate fractions with the same or different particle sizes.

If a conveyor system transports the fractions to the neutron source for the irradiation, then it is thus possible not only to enable a comparatively high mass throughput, but also to facilitate the management of the method in order to ensure a reproducible sorting of aluminum scrap by alloy groups.

The reproducibility of the method can be further improved if the conveyor system has an endless conveyor belt, the neutron source provided between the working side and the return side of the conveyor belt irradiates the fractions of the aluminum scrap through the conveyor belt, and the gamma radiation that the fractions emit due to this neutron irradiation is detected by the detector provided above the working side of the conveyor belt. Because of this arrangement of the neutron source and detector in the manner according to the invention, it is possible to keep the influence of the conveyor system on the sensitivity of the detectors to a bare minimum. It is also possible in this way to achieve a particularly high mass throughput since it permits a more variable handling of aluminum scrap. Not least, it is thus possible to establish the foundations for a method for detecting multiple fractions simultaneously and in a particularly simple way—even with comparatively few devices such as detectors, etc. The method according to the invention nevertheless ensures a high degree of selectivity.

In terms of its management, the method can be further improved if the aluminum scrap is provided in chambers that are demarcated from one another in the conveyor belt of the conveyor system, particularly of the belt conveyor.

If the neutron radiation is conveyed through a lens embodied as a moderator before it strikes the fraction, then it is possible to further increase the precision and reliability of the method. The neutrons can be thermalized by the moderator—i.e. their kinetic energy can be reduced to less than 100 meV—which makes it possible to significantly increase the effective collision cross-section of the neutrons with the atomic nuclei of the material of the fraction to be inspected. The precision of the method can thus be improved because the increased effective collision cross-section results in a greater yield of neutron activation products. Through the function of the moderator as a neutron lens, it is simultaneously possible, during the thermalization of the neutrons, to homogenize the neutron field emitted by the neutron source and also to adjust the direction of the radiation, making it possible to achieve a uniform neutron field over the entire inspection area. This in turn is beneficial to the reliability of the sorting method.

The mass throughput in the method can be further increased if a neutron source irradiates multiple fractions simultaneously. This makes it possible, for example, to simultaneously perform a measurement on fractions that are provided next to one another and/or one after another—due to the comparability of the measurement of multiple simultaneously irradiated fractions, it is possible to further increase the reproducibility of the method.

If in addition, multiple detectors for measuring the gamma radiation that the fractions emit are provided next to one another and/or one after another, then it is possible to further increase the mass throughput of the method.

In this case, if the detectors are provided next to one another and/or one after another and are each associated with a respective fraction in order to measure the gamma radiation that this fraction emits, it is then possible to perform a measurement on multiple aluminum scrap fractions simultaneously while reducing a reciprocal influence of the emitted gamma radiation of the individual fractions. The mass throughput of the method can thus be significantly increased while nevertheless achieving a high precision of the method. If these detectors are shielded laterally from one another in this case, then it is possible to reliably ensure that—particularly with simultaneous measurement of multiple fractions—the emitted gamma radiation only strikes the detector that is associated with the respective fraction. It is thus possible to avoid a distortion of the measurement due to an interference of the detected gamma radiation of multiple fractions. This makes it possible to prevent an increased background radiation or interference radiation from striking the detectors due to unwanted scattering of the gamma radiation onto the detectors. In addition, through a specific geometrical arrangement of the lead shield, it is possible to prevent gamma radiation, which is not emitted by the specimen (for example due to neutron activation of other materials in the apparatus), from striking the detectors. A lead shield constitutes a simple embodiment variant in this regard. It is thus possible to achieve a more reliable, reproducible method.

A simply designed and highly precise apparatus for sorting, particularly chopped, aluminum scrap by alloy groups with a high mass throughput can be achieved with a conveyor system for transporting fractions of aluminum scrap, having a measuring device, which measuring device has at least one neutron source for irradiating the fractions transported by the conveyor system, at least one detector for detecting the gamma radiation that the fractions emit due to this neutron irradiation, and a computing unit for allocating the fractions to an alloy group as a function of their respective relative ratio of weight proportions of at least two of their alloy elements, which relative ratio is determined by the computing unit based on the energy spectrum of the gamma radiation that is detected from the respective fraction, and having a sorting system, which sorts the fractions transported by the conveyor system by their alloy groups that have been allocated to them by the measuring device.

A comparatively high mass throughput and high selectivity can be achieved by means of the apparatus according to the invention if the neutron source is provided between the working side and the return side of the conveyor belt of the conveyor system. This specifically yields an apparatus that makes it possible to position fractions in a particularly variable way and to supply them to the measuring device without having to accept negative impacts with regard to reproducibility. Furthermore, it is thus possible to position the neutron source and/or lenses, etc. comparatively close to the conveyor belt without having to worry about contact with the conveyor system or the aluminum scrap being transported by it. A reliable irradiation of the fractions can be expected, which can promote the reliability of the apparatus in the sorting of the aluminum scrap by alloy groups.

The conveyor belt of the conveyor system can be used for separating the aluminum scrap if it has chambers that are demarcated from one another. Depending on the structural embodiment of the chambers, it is thus also possible to limit the volume of the fraction in simply designed way, which can have a positive effect on the selectivity of the method and the sorting quality of the apparatus.

In a simply designed way, the conveyor belt can have multiple chambers situated next to one another in rows and one after another in columns so as to thus increase the mass throughput of the apparatus.

The selectivity of the apparatus and thus its sorting quality can be further improved if a lens embodied as a moderator is provided between the neutron source and fraction.

BRIEF DESCRIPTION OF THE DRAWINGS

In the figures, the subject of the invention is shown in greater detail by way of example based on an embodiment variant. In the drawings.

WAYS TO EMBODY THE INVENTION

Figure 1:
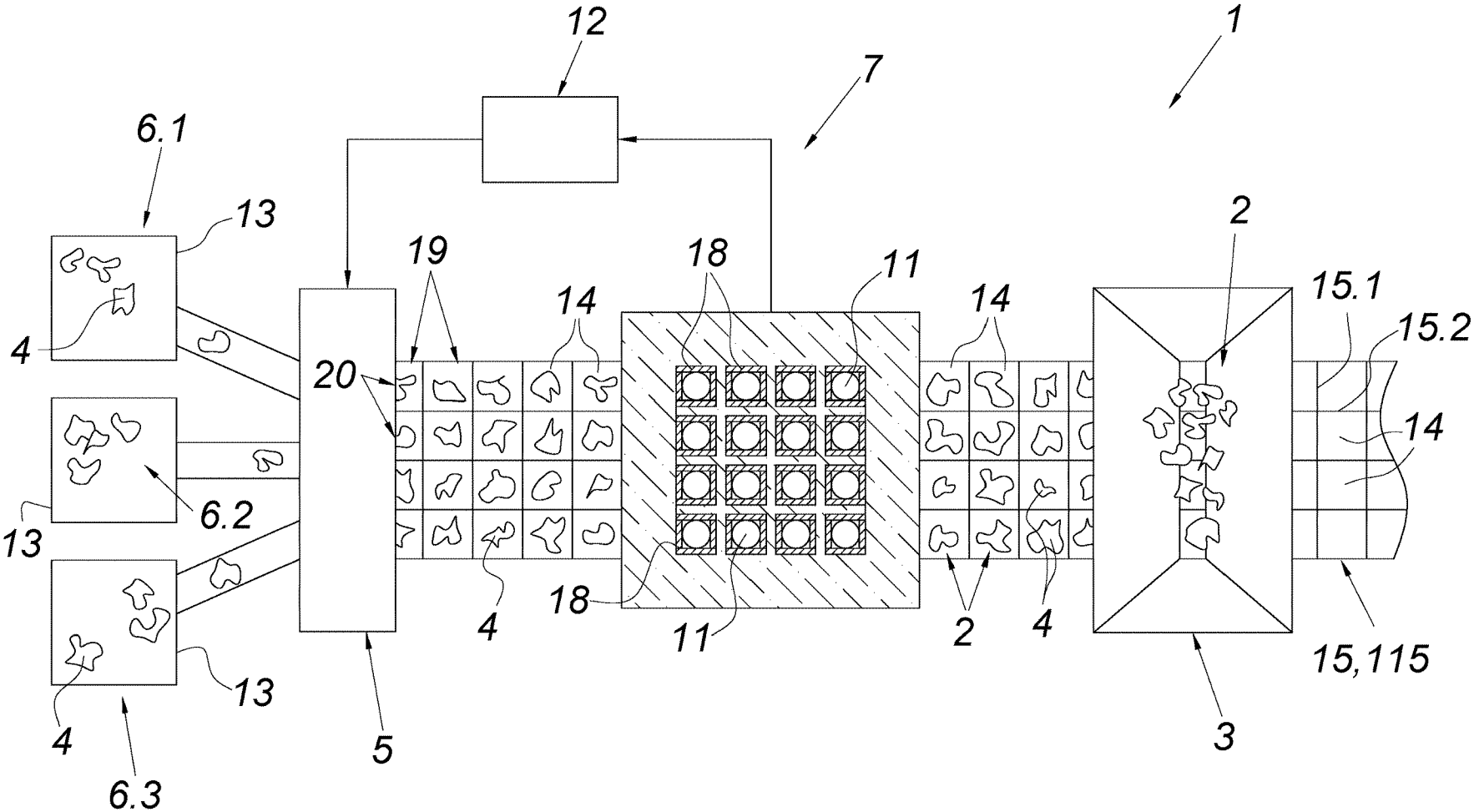
FIG. 1 shows a schematic top view of an apparatus for carrying out the method according to the invention and FIG. 2 shows a sectional view through the apparatus shown in FIG. 1.
Figure 2:
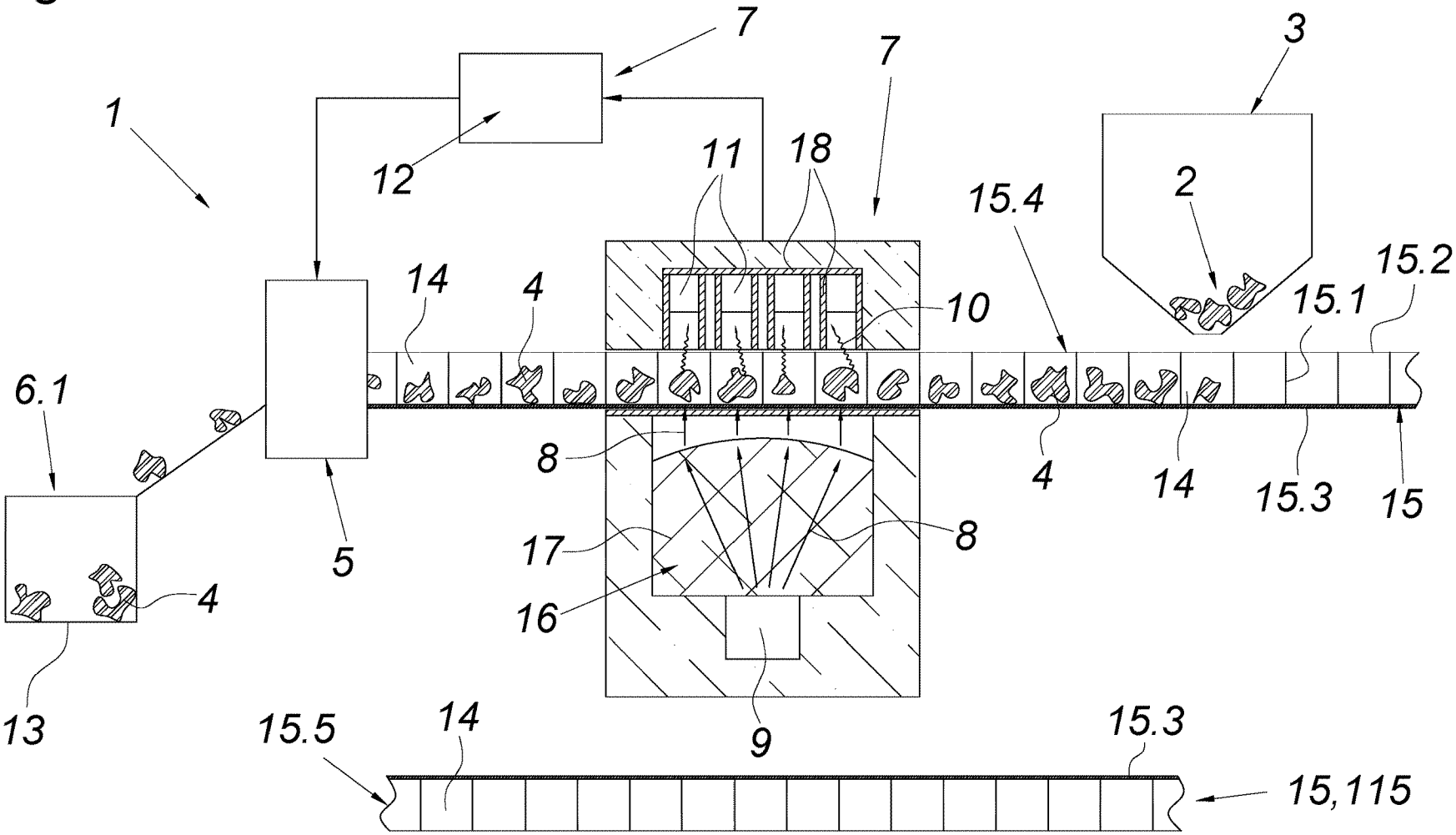

FIG. 1 and FIG. 2 show a method 1 for sorting chopped or shredded aluminum scrap 2 in which the aluminum scrap 2 is chopped and/or sifted and/or homogenized for example to 10 to 120 mm in a unit 3 and then divided and/or separated into fractions 4. Finally, a sorting system 5 sorts these fractions 4 by alloy groups 6.1 (e.g.: aluminum forging alloy of the alloy group 6xxx), 6.2 (aluminum forging alloy of the alloy group 7xxx), and 6.3 (aluminum casting alloy of the alloy group 3xx-AlSiCu).

As shown in FIGS. 1 and 2, the aluminum scrap 2 is dispensed into chambers 14 that are demarcated from one another and is thus separated into individual fractions 4. In general, it should be noted that a fraction 4 can consist of a single piece of aluminum scrap or multiple pieces of aluminum scrap and/or also of aluminum scrap granulates or aluminum scrap powders that are composed of the aluminum scrap 2.

In the simplest structural embodiment, the conveyor system 15 can constitute only one belt conveyor 115, which transports the fractions 4 from the separating unit 3 through the PGNAA measuring system 7 to the sorting system 5. As is apparent in the exemplary embodiment, the demarcated chambers 14 are composed of driving elements 15.1 and longitudinal slats 15.2 of an endless conveyor belt 15.3 of a conveyor system 15.

The fractions 4 of the aluminum scrap 2 are supplied to a PGNAA measuring device 7, which is data-connected to the sorting system 5. In the PGNAA measuring device 7, the fractions 4 are irradiated with neutron radiation 8 of a neutron source 9 and the gamma radiation 10 emitted by the individual fractions 4 because of the resulting activation of their nuclei is detected by a respective detector 11. Data about the gamma radiation 10 of the individual fractions 4 are thus generated. The measurement data of the detector 11 are supplied to a computing unit 12 of the measuring device 7. It is thus possible to generate energy spectra associated with the respective fractions 4. Based on the energy spectrum of the respective fraction, a relative ratio of the weight proportions of at least two alloy elements of this fraction 4 is determined. Then based on the relative ratios of the weight proportions of alloy elements, the computing unit 12 thus individually allocates the fractions 4 to an alloy group 6.1, 6.2, or 6.3.

In accordance with this allocation, the PGNAA measuring device 7 activates the sorting system 5 in such a way and is data-connected to the sorting system 5 in such a way that a fraction 4 is separated out into a respective receptacle 13 in accordance with its corresponding alloy group 6.1, 6.2, or 6.3.

Such a conveyor system 15 can enable a particularly high mass throughput in the method, but can also be used for separating the aluminum scrap 2 into fractions 4.

As is also clear from FIG. 2, the neutron source 9 is provided between the working side 15.4 and the return side 15.5 of the conveyor belt 15.3 and thus irradiates the fractions 4 of the aluminum scrap 2 through the working side 15.4 of the conveyor belt 15.3. The gamma radiation 10 emitted by the fractions 4 is detected by the detector 11 provided above the working side of the conveyor belt 15.3. This type of arrangement of the neutron source 9 and detector 11 achieves a compact apparatus and also makes it possible to achieve a very low interfering influence of the conveyor system 15 on the measurement, especially so that the return side 15.5 of the conveyor belt 15.3 has no influence on the irradiation of the fractions 4. The method according to the invention therefore has not only a high mass throughput, but also a high degree of selectivity.

As can be particularly inferred from FIG. 2, the neutron radiation 8 from the neutron source 9 is conveyed through a lens 16 before the neutron radiation 8 strikes the fractions 4. This equalizes and homogenizes the divergent neutron radiation 8 emerging from the neutron source 9 so that it is possible to ensure that the neutron radiation 8 striking the fractions 4 is comparable in each chamber 14. This in turn makes it possible to simultaneously act on multiple fractions 4 with the neutron radiation 8 of the neutron source 9. In addition, the lens 16 is embodied as a moderator 17, as a result of which the neutrons of the neutron radiation 8 are thermalized, i.e. are decelerated to kinetic energies below approximately 100 meV. The effective collision cross-section of the neutron radiation 8 with the nuclei of the fractions 4 can thus be significantly increased, which has a positive effect on the measurement precision of the method.

Particularly in order to enable a high mass throughput, multiple detectors 11 for measuring the gamma radiation 10 emitted by the fractions 4 are provided next to one another in the PGNAA measuring system. As can be inferred from FIG. 1, in particular 16 detectors 11 are arranged in four rows 19 and four columns 20, specifically in accordance with the chambers 14 of the conveyor belt 15.3 that are arranged in this way. It is thus possible to achieve a high degree of parallelism for a high mass throughput.

As is clear from FIGS. 1 and 2, the detectors 11 are provided with respective shields 18. Because these detectors are shielded laterally from one another, it is advantageously possible to ensure that only the gamma radiation 10 emitted by the fraction 4 associated with the detector 11 actually strikes the respective detector 11. Otherwise, the emitted gamma radiation 10 of an external fraction 4 could interfere with the gamma radiation 10 to be measured and could thus distort the energy spectrum. A lead shield 18 has proven to be useful for producing a reliable shield.

The invention claimed is:

1. A method for sorting chopped, aluminum scrap by alloy groups, the method comprising:

separating the aluminum scrap into a plurality of fractions;

irradiating the plurality of fractions of the aluminum scrap using at least one neutron source;

using at least one detector to detect gamma radiation that an individual fraction emits due to neutron irradiation;

based on the gamma radiation detected, generating an energy spectrum associated with a respective fraction;

based on the energy spectrum, determining a relative ratio of weight proportions of each of at least two alloy elements of the respective fraction with respect to one another;

based on the relative ratio, allocating the respective fraction to a corresponding alloy group; and then sorting each of the plurality of fractions by alloy groups to which each of the fractions have been allocated.

2. The method according to claim 1, comprising providing the aluminum scrap in chambers that are demarcated from one another and thus separating the aluminum scrap into the plurality of fractions.

3. The method according to claim 1, comprising using a conveyor system to transport the plurality of fractions to the at least one neutron source for the irradiation.

4. The method according to claim 3, wherein the conveyor system has an endless conveyor belt and the neutron source, which is provided between a working side and a return side of the conveyor belt, irradiates the plurality of fractions of the aluminum scrap through the conveyor belt and the gamma radiation that the plurality of fractions emit due to this neutron irradiation is detected by the detector provided above the working side of the conveyor belt.

5. The method according to claim 3, comprising providing the aluminum scrap in chambers that are demarcated from one another in a conveyor belt of the conveyor system.

6. The method according to claim 1, comprising conveying the neutron radiation through a lens embodied as a moderator before the neutron radiation strikes the plurality of fractions.

7. The method according to claim 1, wherein the at least one neutron source irradiates multiple fractions simultaneously.

8. The method according to claim 1, wherein a plurality of detectors for measuring the gamma radiation emitted by the fractions are provided next to one another and/or one after another.

9. The method according to claim 8, wherein the plurality of detectors, which are provided next to one another and/or one after another and are each allocated to a respective fraction to measure the gamma radiation emitted by the respective fraction, are shielded laterally from one another by a lead shield.

10. An apparatus for sorting chopped, aluminum scrap by alloy groups, the apparatus comprising:

a conveyor system for transporting fractions of the aluminum scrap;

a measuring device having at least one neutron source for irradiating the fractions transported by the conveyor system, at least one detector for detecting gamma radiation that the fractions emit due to neutron irradiation, and a computing unit for allocating the fractions to an alloy group as a function of their respective relative ratio of weight proportions of each of at least two of their alloy elements with respect to one another, which relative ratio is determined by the computing unit based on an energy spectrum of the gamma radiation that is detected from the respective fraction; and a sorting system, which sorts the fractions transported by the conveyor system by their alloy groups that have been allocated to each fraction by the measuring device.

11. The apparatus according to claim 10, wherein the neutron source is provided between a working side and a return side of the conveyor belt of the conveyor system.

12. The apparatus according to claim 10, wherein the conveyor belt of the conveyor system has chambers that are demarcated from one another for separating and transporting fractions.

13. The apparatus according to claim 12, wherein the conveyor belt has a plurality of chambers situated next to one another in rows and one after another in columns.

14. The apparatus according to claim 10, comprising a lens between the at least one neutron source and at least one of the fractions, wherein the lens is a moderator.

* * * * *